United States Patent [19]

Mehta et al.

[11] Patent Number: 4,769,902

[45] Date of Patent: Sep. 13, 1988

[54] THERMAL FUSE

[75] Inventors: Mahendra C. Mehta, Palm Beach Gardens; Wen J. Chen, West Palm Beach, both of Fla.

[73] Assignee: Northern Telecom Limited, Montreal, Canada

[21] Appl. No.: 59,817

[22] Filed: Jun. 9, 1987

[51] Int. Cl.[4] ..... H01H 69/02

[52] U.S. Cl. ..... 29/623; 29/851; 29/852; 164/34

[58] Field of Search ..... 29/623, 846, 848, 849, 29/851, 852; 361/321 C; 264/61, 59; 337/296, 297, 282

[56] References Cited

U.S. PATENT DOCUMENTS 2,134,752 11/1938 Ehlers ..... 264/61
4,030,004 6/1977 Rutt ..... 264/61
4,189,760 2/1980 Marshall ..... 264/61
4,652,967 3/1987 Sakabe et al. ..... 361/321

FOREIGN PATENT DOCUMENTS 257088 8/1926 United Kingdom ..... 29/623

*Primary Examiner*—P. W. Echols
*Attorney, Agent, or Firm*—Foley & Lardner, Schwartz, Jeffery, Schwaab, Mack, Blumenthal & Evans

[57] ABSTRACT

A thermal fuse is formed by a conductive path formed in a ceramic body, the path being of a fusible alloy. A ceramic substrate and a ceramic cover, both in green form, are fused together with defined channels. The channels can be defined by a material which is burnt out, preferably when the ceramic members are fused together. The channels can be defined in other ways. The channels are filled with a fusible alloy leaving an air layer, end contacts being provided. Several channels can be formed in one assembly. The assembly can then be cut into separate fuses, each with one channel.

4 Claims, 2 Drawing Sheets

THERMAL FUSE

BACKGROUND OF THE INVENTION

1. Field of the Invention

This invention relates to thermal fuses and, in particular, to a form of thermal fuse for use in electronic and similar circuits.

2. Related Art

In electronic devices, components are mounted on, or formed as part of, a conductive circuit pattern. Such a circuit pattern may be formed on a surface of a circuit board or on a surface of a ceramic or other substrate. To protect the components, it is desirable to provide some means for opening the circuit if an overload occurs.

SUMMARY OF THE INVENTION

The present invention provides a thermal fuse in which a fusible alloy forms a conductive path through the fuse under normal conditions, with the fusible alloy melting and opening the circuit when the thermal fuse reaches a predetermined temperature.

In its broadest concept, a thermal fuse comprises a thin member having at least one electrical path therethrough, filled with a fusible alloy, with connections made to each end of the path. In particular, the path is formed between two plates of ceramic material. The ceramic plates can be in a green form when put together, the path defined by a material capable of being removed when the ceramic plates are fired. During firing, the ceramic plates fuse together, except where the removable material is positioned. After removal of the material, the path is filled with a fusible alloy. Other ways of forming the paths can be used.

BRIEF DESCRIPTION OF THE DRAWINGS

The invention will be readily understood by the following decription of certain embodiments, by way of example, in conjunction with the accompanying drawings, in which.

DETAILED DESCRIPTION OF THE PREFERRED EMBODIMENTS

Figure 1:
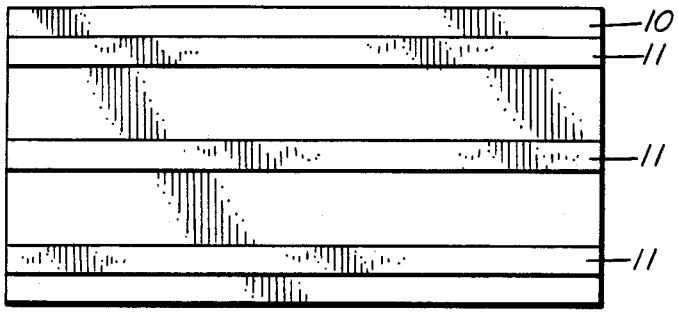
FIG. 1 is a plan view on a substrate with three paths defined.
Figure 2:
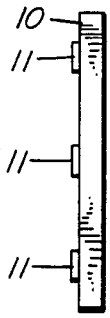
FIG. 2 is an end view of the substrate in FIG. 1.
Figure 3:
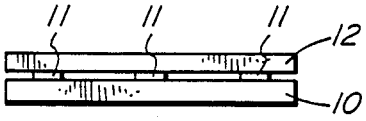
FIG. 3 is an end view of the substrate in FIG. 1, with a further member placed thereon, the substrate and member of green ceramic.
Figure 4:
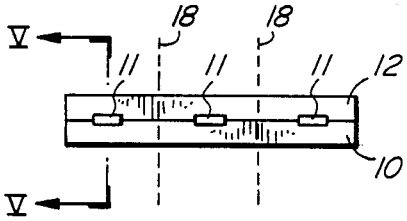
FIG. 4 is a similar view to that of FIG. 3, prior to firing.
Figure 5:
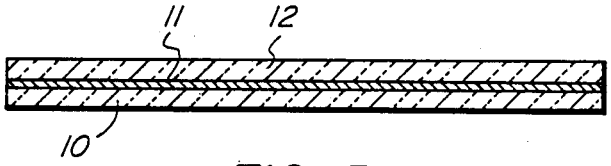
FIG. 5 is a cross-section on the line V—V of FIG. 4, after firing with spacer material in position.

Illustrated in FIGS. 1 and 2 is a substrate 10, in the example ceramic, with three stripes 11 formed on one surface. A typical example of the material forming the stripes 11 is carbon. The stripes can be formed by screen printing or otherwise depositing a carbon ink on the surface of the substrate. As illustrated in FIG. 3, the cover member 12 is positioned on the substrate 10, over the stripes 11. The substrate and cover are of green ceramic, that is, ceramic in an unfired condition. Pressing the cover and substrate together causes them to deform round the strips until they are in contact. This is illustrated in FIG. 4 and in FIG. 5.

Figure 6:
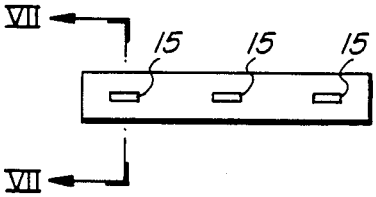
FIG. 6 is a view similar to FIG. 4, but after firing.
Figure 7:
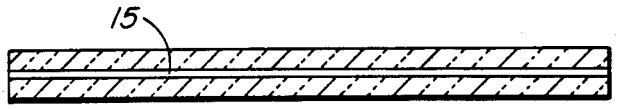
FIG. 7 is a cross-section on the line VII—VII of FIG. 6.
Figure 8:
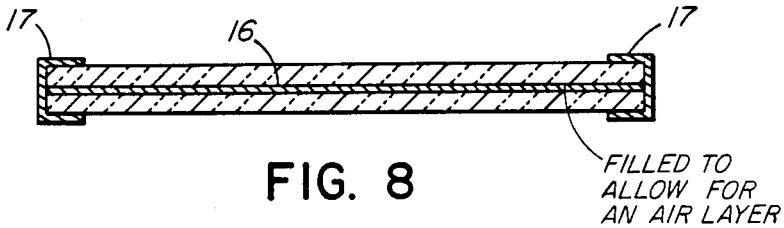
FIG. 8 is a cross-section as in FIG. 7, but with a fusible alloy in position.

The assembly is then fired. During firing, the ceramic cover and substrate become fused together on either side of the stripes. Also, usually at the same time, the material forming the strips burns out to leave open channels 15, as illustrated in FIGS. 6 and 7. A typical temperature range for firing is 1500° to 2000° C. p The channels 15 are then filled with a fusible alloy to form conductive paths, indicated at 16 in FIG. 8. The ends of the assembly can be metallized as at 17 in FIG. 8, to produce contact areas. The metallization makes contact with the conductive paths 16. Generally, the assembly is cut into strips with one channel to each strip, to form a fuse, as indicated by dotted lines 18 in FIG. 4. However, assemblies with more than one channel can be provided.

Figure 9:
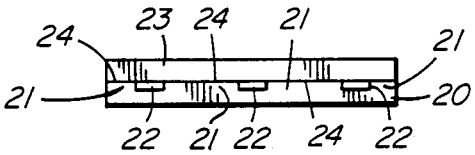
FIG. 9 is an end view of an alternative form of structure.

FIG. 9 is an end view of an alternative arrangement for forming channels. In this embodiment, substrate 20 has ribs 21 formed on one surface, the ribs defining three channels 22. A cover member 23 is positioned on the substrate and the two fused together at the top surfaces of the ribs, at 24. This defines channels into which a fusible alloy is filled to form conductive paths. The substrate can be of ceramic, formed in its green state and then fired to form the channels. The cover can also be of ceramic.

The dimensions of a fuse can vary, but one particular example is about 120 mil by 60 mil. The thickness of the substrate can vary. One exemplary thickness is 10 mil. The stripe or stripes can be about ½ to 1 mil thick. Instead of ceramic, other forms of dielectric can be used. Thus, a synthetic resin plastic material having a high temperature characteristic can be used. With such a material, the substrate can be channelled to define the paths and a top cover will be bonded into position. Both the substrate and the cover can be channelled with the channels aligned to define the paths. If both the substrate and the cover are channelled, with the channels offset relative to each other, then two separate path arrangements can be provided.

Figure 10:
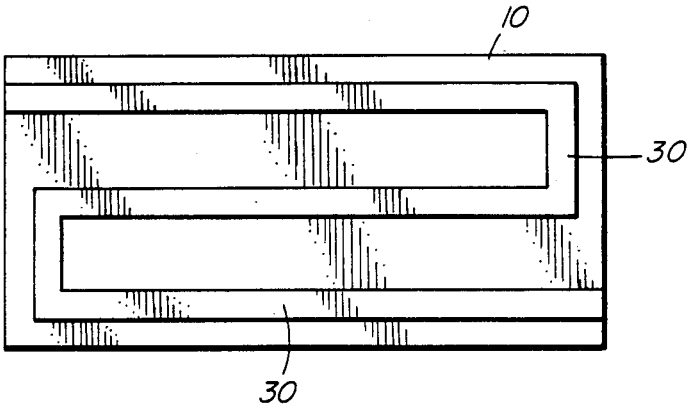
FIG. 10 is a plan view of a substrate showing a different form of path.

While in the examples described and illustrated straight paths extending from one end of the substrate to the other, a path may take a sinuous or zigzag or other form. FIG. 10 is a plan view on a substrate 10 in which a zigzag pattern 30 has been formed which will eventually form a zigzag path.

The fusible alloy material is filled into the channels under pressure in a liquid state. The channels are not completely filled, a very thin layer of air extends over the alloy material when it solidifies. The alloy material can vary in composition, depending upon the temperature at which it is desired that the alloy willl melt, a typical temperature being about 250° C. On melting, the alloy will break up into isolated sections and thus break the circuit through the fuse.

The form of the fuse can vary, as can also the dimensions. A fuse can be mounted by insertion into spring contact members, for easy replacement. Alternatively, it can be mounted on a circuit board by soldering. Other forms of contact member can be provided at each end, including leaded contact members. Fuse members may be mounted on tape or other means for automated placement. Several fuse members can be formed as a single unit, and can also be formed integral with some other component. A number of fuse members can also be formed by superimposing several substrates, forming a multilayer assembly. One or more conductive, fusible, paths can be formed between each pair of substrates.

What is claimed is:

1. A method of manufacturing a thermal fuse comprising the steps of: forming at least one stripe of thermally decomposable material on a surface of a first thin green ceramic member;

positioning a second thin green ceramic member on said first member and pressing together to enclose said stripe;

fusing the green ceramic members into a unitary member and burning out said thermally decomposable material to leave a channel at the same time;

filling said channel with a fusible alloy to a level allowing for a layer of air in order to form a conductive path, said conductive path being broken into isolated sections by melting of the alloy; and forming contacts at each end of said path.

2. The method of claim 1, including forming a plurality of spaced parallel stripes on said first thin green ceramic member; fusing the ceramic members together to form a plurality of channels; dividing the unitary ceramic material into a plurality of parts, each part including one channel, after filling said channels with the fusible alloy.

3. The method of claim 2, including forming the contacts before dividing.

4. The method of claim 2, including forming the contacts after dividing.

* * * * *